US007135104B2

(12) United States Patent
Bonnardel et al.

(10) Patent No.: US 7,135,104 B2
(45) Date of Patent: Nov. 14, 2006

(54) METHOD FOR REGULATING AN ELECTROLYSIS CELL

(75) Inventors: Oliver Bonnardel, Saint Martin d'arc (FR); Claude Vanvoren, Saint Jean de Maurienne (FR)

(73) Assignee: Aluminum Pechiney, Paris (FR)

( * ) Notice: Subject to any disclaimer, the term of this patent is extended or adjusted under 35 U.S.C. 154(b) by 400 days.

(21) Appl. No.: 10/467,482

(22) PCT Filed: Feb. 27, 2002

(86) PCT No.: PCT/FR02/00705

§ 371 (c)(1),
(2), (4) Date: Mar. 15, 2004

(87) PCT Pub. No.: WO02/068726

PCT Pub. Date: Sep. 6, 2002

(65) Prior Publication Data

US 2004/0168931 A1 Sep. 2, 2004

(30) Foreign Application Priority Data

Feb. 28, 2001 (FR) ..... 01 02722

(51) Int. Cl.
*C25C 3/20* (2006.01)

(52) U.S. Cl. ..... 205/336; 205/337; 205/372; 205/374; 205/392; 205/394; 205/396; 374/139

(58) Field of Classification Search ..... 205/336, 205/337, 372, 374, 392, 394, 396; 374/139
See application file for complete search history.

(56) References Cited

U.S. PATENT DOCUMENTS 4,446,350 A 5/1984 Mizukawa et al.
4,668,350 A * 5/1987 Desclaux et al. ..... 205/336
5,094,728 A 3/1992 Entner
5,882,499 A * 3/1999 Bonnardel et al. ..... 205/396
6,183,620 B1 3/2001 Verstreken

FOREIGN PATENT DOCUMENTS

RU 2106435 3/1998
WO WO 99/41432 8/1999

OTHER PUBLICATIONS

Peter M. Entner: "Control of $AlF_3$ Concentration", Light Metals, 1992, pp. 369-374.
M. J. Wilson: "Practical Considerations Used in the Development of a Method for Calsulating Aluminium Fluoride Additions Based on Cell Temperatures", Light Metals, 1992, pp. 375-378.

* cited by examiner

*Primary Examiner*—Bruce F. Bell
(74) *Attorney, Agent, or Firm*—Baker Donelson Bearman Caldwell & Berkowitz PC

(57) ABSTRACT

The invention relates to a regulation method for an electrolytic cell for the production of aluminium by means of reduction of alumina dissolved in a molten cryolite bath and comprises the addition, in the electrolyte bath, during predetermined time intervals p referred to as "periods", of a determined quantity Q(p) of aluminium trifluoride ($AlF_3$) determined by the following equation: Q(p)=Qint(p)−Qc1(p)+Qt(p), where Qint(p) is an integral (or "self-adaptive") term which represents the total actual $AlF_3$ requirements of the cell and which is calculated from a mean Qm(p) of the actual $AlF_3$ supplies made during the last N periods, Qc1 is a compensating term corresponding to the so-called "equivalent" quantity of $AlF_3$ contained in the alumina added to the cell during the period p, and Qt(p) is a corrective term which is a typically increasing function of the difference between the measured bath temperature T(p) and the set-point temperature To. The method according to the invention makes it possible to regulate effectively the acidity of an electrolytic cell at intensities of up to 500 kA with an electrolyte bath having an $AlF_3$ content greater than 11%.

30 Claims, 7 Drawing Sheets

METHOD FOR REGULATING AN ELECTROLYSIS CELL

CROSS REFERENCE TO RELATED APPLICATIONS

The present application is a National Stage Application of PCT/FR02/00705 filed Feb. 27, 2002, which claims priority to French Application No. 01/02722 which was filed Feb. 28, 2001.

1. Field of the Invention

The invention relates to a regulation method for an aluminium production cell by means of electrolysis of alumina dissolved in an electrolyte based on molten cryolite, particularly according to the Hall-Héroult method. It particularly relates to the regulation of the quantity of aluminium trifluoride ($AlF_3$) of the cryolite bath.

2. State of the Art

Metal aluminium is produced industrially by igneous electrolysis, i.e. by means of electrolysis of alumina in solution in a molten cryolite bath, referred to as an electrolyte bath, particularly according to the well-known Hall-Héroult method. The electrolyte bath is contained in pots, referred to as "electrolytic pots", comprising a steel shell, which is coated internally with refractory and/or insulating materials, and a cathode assembly located at the base of the pot. Anodes made of carbonaceous materials are partially immersed in the electrolyte bath. The assembly formed by an electrolytic pot, its anode(s) and the electrolyte bath is referred to as an electrolytic cell.

The electrolytic current, which flows in the electrolyte bath and the pad of liquid aluminium via the anodes and cathode components, brings about the aluminium reduction reactions and also makes it possible to maintain the electrolyte bath at a temperature of the order of 950° C. by means of the Joule effect. The electrolytic cell is regularly supplied with alumina so as to compensate for the alumina consumption produced by the electrolytic reactions.

The productivity and Current efficiency of an electrolytic cell are influenced by several factors, such as the intensity and distribution of the electrolytic current, the pot temperature, the dissolved alumina content and the acidity of the electrolyte bath, etc., which interact with each other. For example, the melting temperature of a cryolite bath decreases with the excess aluminium trifluoride ($AlF_3$) with reference to the nominal composition (3 $NaF.AlF_3$). In modern plants, the operating parameters are adjusted to aim for Current efficiencies of over 90%.

However, the effective Current efficiency of a cell is significantly influenced by variations in said cell's parameters. For example, an increase in the electrolyte temperature by around ten degrees Celsius may cause the Current efficiency to fall by approximately 2% and a decrease in the electrolyte temperature by around ten degrees Celsius may reduce the already low solubility of alumina in the electrolyte and favour the "anode effect", i.e. anode polarisation, with a sudden rise in the voltage at the cell terminals and the release of a large quantity of fluorinated and fluoro-carbonated products, and/or insulating deposits on the cathode surface.

Therefore, the operation of an electrolytic cell requires precise control of its operating parameters, such as its temperature, alumina content, acidity, etc., so as to maintain them at determined set-point values. Several regulation methods have been developed to achieve this objective. These methods generally relate to the regulation of the alumina content of the alumina bath, the regulation of its temperature, or the regulation of its acidity, i.e. the excess $AlF_3$.

The American patent U.S. Pat. No. 4,668,350 discloses a method to control $AlF_3$ additions wherein $AlF_3$ is added at a determined rate, the temperature of the bath is measured regularly and the $AlF_3$ addition rate is adjusted according to the difference between the temperature measured in the pot and the target temperature (the addition rate is increased when the temperature measured is greater than the set-point temperature and decreased otherwise). The $AlF_3$ addition rate can also be corrected according to the deviation of the temperature measured (the rate is increased when the temperature measured is greater than the previous value and decreased otherwise). This method, which is based on the correlation between the temperature and the $AlF_3$ content of the bath, does not take into account the impact of transient periods. In addition, this method handles thermal deviations poorly since it does not take into account the actual quantity of $AlF_3$ contained in the pot.

The American patent U.S. Pat. No. 5,094,728 discloses a regulation method wherein the optimal time lag between $AlF_3$ additions and their effect on the electrolyte is calculated using a model comprising several parameters, and the quantities of $AlF_3$ to be added during the next n days are calculated using, firstly, the difference between the target $AlF_3$ concentration of the bath and the measured value and, secondly, the theoretical daily consumption. The parameters are calculated using the measurements made on the pot during a long time interval, of the order of 10 to 60 days. This method requires the development and set-up of a complex model which is moreover not disclosed in this document.

The international application WO 99/41432 discloses a regulation method wherein the liquidus temperature of the electrolyte bath is measured and the liquidus temperature measured is compared to a first and a second set-point value; if the liquidus temperature is greater than the first set-point value, $AlF_3$ is added; if it is less than the second set-point value, NaF or $Na_2CO_3$ is added. This regulation method requires a reliable, rapid and economical measurement of the liquidus temperature. The liquidus temperature is generally determined from a complex equation which takes into account the exact composition of the electrolyte bath, particularly its NaF, $AlF_3$, $CaF_2$, LiF and $Al_2O_3$ contents.

Statement of the Problem

Aluminium producers, in the continuous aim to increase electrolytic plant production and productivity at the same time, try to push back these limits.

In particular, in order to increase plant productivity, it is aimed to reach Current efficiencies above 95% operating with $AlF_3$ excesses of over 11%, and which may reach 13 to 14%, which makes it possible to decrease the cell operating temperature (the liquidus temperature drops approximately 5° C./% $AlF_3$) and, as a result, reduce the energy consumption of said cells. However, in this chemical composition range, the solubility of alumina is considerably reduced, which increases the risks of anode effects and of insulating deposits on the cathode.

In addition, in order to increase plant production, it is aimed to increase the unit capacity of cells and, in correlation, increase the intensity of the electrolytic current. The current trend is to develop electrolytic cells with a current greater than or equal to 500 kA. The increase in the capacity of electrolytic cells may be obtained, as a general rule, either by increasing the permissible intensity of cells of known type or existing cells, or by developing very large cells. In the first case, the increase in the permissible intensity results in a decrease in the electrolyte bath mass, which exacerbates the instability effect. In the second case, the increase in the cell size increases their thermal and chemical inertia. Consequently, the increase in cell capacity not only increases the rate of alumina consumption but also amplifies instability generation and cell deviation phenomena, which increases difficulties in controlling electrolytic cells.

Therefore, the applicant searched for a regulation method for an electrolytic cell, particularly of the electrolyte bath acidity (i.e. its $AlF_3$ content) and the overall thermics of the cell, which makes it possible to control, in a stable manner with a Current efficiency greater than 93%, or even greater than 95%, without having to use frequent $AlF_3$ content measurements, electrolytic cells wherein the excess $AlF_3$ is greater than 11% and wherein the current may be greater than or equal to 500 kA.

DESCRIPTION OF THE INVENTION

The invention relates to a regulation method for an electrolytic cell intended for the production of aluminium by means of igneous electrolysis, i.e. by flowing current in an electrolyte bath based on molten cryolite and containing dissolved alumina, particularly according to the Hall-Héroult method.

The regulation method according to the invention comprises the addition, in the electrolyte bath of an electrolytic cell, during pre-determined time intervals p referred to as "regulation periods", of a determined quantity Q(p) of aluminium trifluoride ($AlF_3$) determined by the following equation:

$$Q(p)=Qint(p)-Qc1(p)+Qt(p)$$

where

Qint(p) is an integral (or "self-adaptive") term which represents the total actual $AlF_3$ requirements of the cell and which is calculated from a determination Qm(p) of the actual $AlF_3$ supplies made during the last period or the last N periods, Qc1 is a compensating term corresponding to the so-called "equivalent" quantity of $AlF_3$ contained in the alumina added to the cell during the period p, said quantity being possibly positive or negative, Qt(p) is a corrective term which is a determined function (which is typically increasing) of the difference between the measured bath temperature T(p) and the set-point temperature To.

The term Qint(p) takes into account $AlF_3$ losses in the bath occurring during normal cell operation and which are essentially produced by absorption by the pot crucible and emissions in gaseous effluents. This term, the mean value of which is not equal to zero, is particularly used to monitor pot ageing, without having to model it, by means of a memory effect of pot behaviour over time. It also takes into account the specific ageing of each pot, that the applicant generally found to be markedly different to the average ageing of the population of pots of the same type.

The term Qm(p) takes into account total equivalent $AlF_3$ supplies, i.e. "direct" supplies from additions of $AlF_3$ and "indirect" supplies from additions of alumina.

In a preferred alternative embodiment of the invention, the calculation formula of the quantity Q(p) comprises an additional term Qc2(p), i.e. Q(p)=Qint(p)−Qc1(p)+Qt(p)+Qc2(p), where Qc2(p) is a corrective term which is a determined function (which is typically decreasing) of the difference between Qm(p) and Qint(p).

The term Qc2 is a prospective correction term which is used to take into account the effect of an addition of $AlF_3$ in advance, which normally only appears after a few days. Indeed, the applicant noted the surprising degree of the difference between the time constant of the temperature variation, which is low (of the order of a few hours) and that of the $AlF_3$ content, which is very high (of the order of a few tens of hours). In its tests, it found that it was very advantageous to anticipate the variation of the acidity of the pot when adding $AlF_3$, which is made possible effectively by the term Qc2.

The terms Qt(p) and Qc2(p) are terms wherein the mean value over time normally tends towards zero (i.e. they are normally equal to zero on average).

In addition, the applicant noted in its tests that the combined effect of the basic terms, i.e. Qt, Qint, Qc1 and, advantageously, Qc2, made it possible to provide reliable regulation, i.e. with a high stability, of the $AlF_3$ content of electrolytic cells, over a period of several months, even without accounting for measured $AlF_3$ contents, which measurements add to cell operating costs and are, in any case, easily affected by significant errors.

FIGURES

Figure 1:
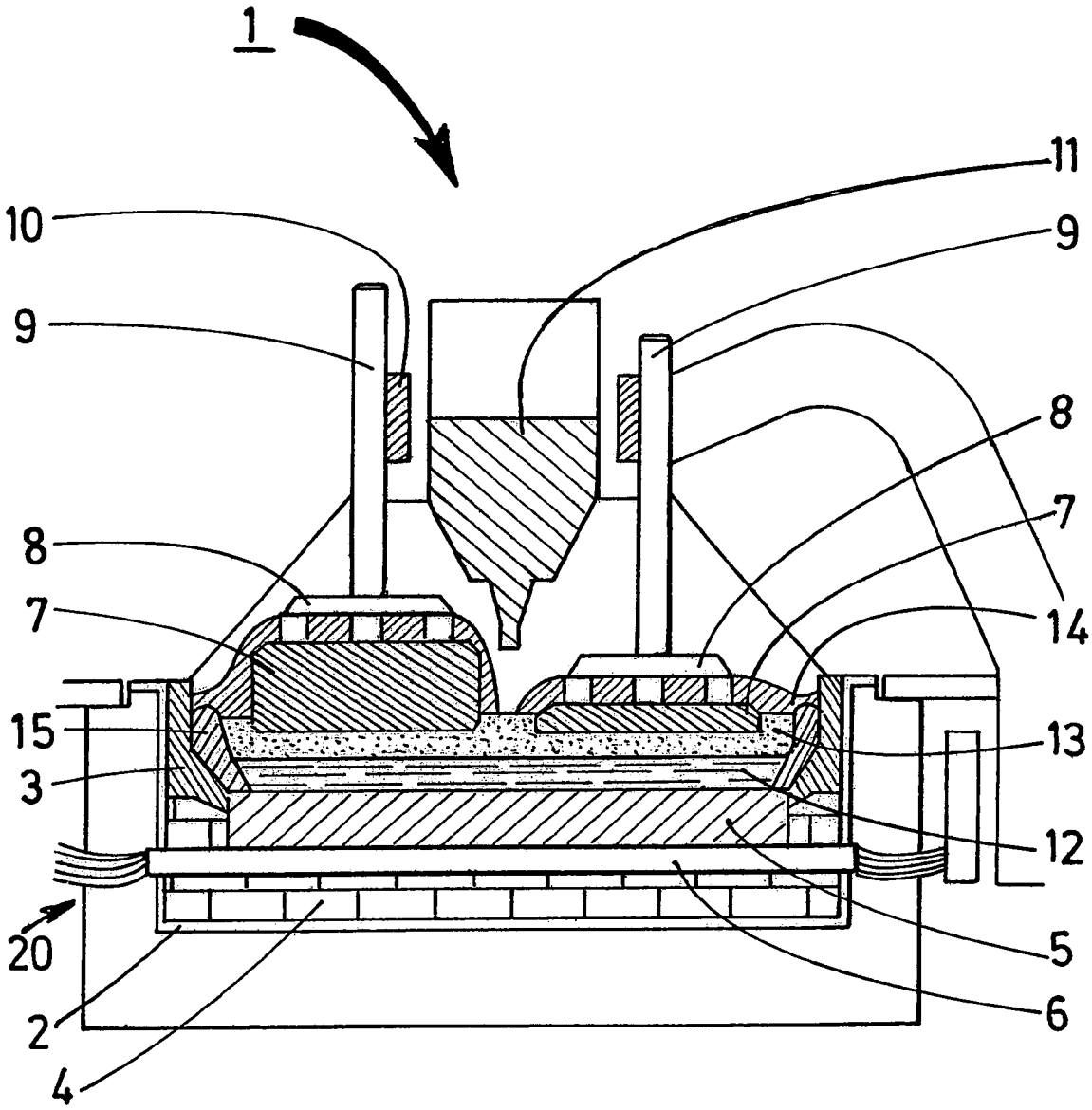
FIG. 1 represents, in a transverse section, a typical electrolytic cell.

As illustrated in FIG. 1, an electrolytic cell 1 for the production of aluminium by means of the electrolysis method typically comprises a pot 20, anodes 7 supported by attachment means 8, 9 to an anode frame 10 and alumina supply means 11. The pot 20 comprises a steel shell, internal lining components 3, 4 and a cathode assembly 5, 6. The internal lining components 3, 4 are generally blocks made of refractory materials, which may be heat insulators. The cathode assembly 5, 6 comprises connection bars 6 to which the electric conductors used to route the electrolytic current are attached.

The lining components 3, 4 and the cathode assembly 5, 6 form, inside the pot 20, a crucible capable of containing the electrolyte bath 13 and a liquid metal pad 12 when the cell is in operation, during which the anodes 7 are partially immersed in the electrolyte bath 13. The electrolyte bath contains dissolved alumina and, as a general rule, an alumina layer 14 covers the electrolyte bath.

The electrolytic current transits in the electrolyte bath 13 via the anode frame 10, the attachment means 8, 9, anodes 7 and cathode components 5, 6. The purpose of the alumina supply to the cell is to compensate for the approximately continuous consumption of the cell which is essentially due to the reduction of alumina into metal aluminium. The alumina supply, which is made by adding alumina into the liquid bath 13 (typically using an crustbreaker-feeder 11) is generally regulated separately.

The metal aluminium 12 which is produced during the electrolysis is accumulated at the bottom of the cell and a relatively sharp interface between the liquid metal 6 and the molten cryolite bath 13 is established. The position of this bath-metal interface varies over time: it rises as the liquid metal accumulates at the bottom of the cell and it goes down when the liquid metal is removed from the cell.

As a general rule, an attempt is made to form a ridge 15 of solidified cryolite on the part of the side walls 3 of the crucible which are in contact with the electrolyte bath 7 and with the liquid metal pad 12.

Several electrolytic cells are generally arranged in a row, in buildings referred to as electrolysis rooms, and connected electrically in series using connection conductors. The cells are typically arranged so as to form two or more parallel lines. The electrolytic current thus flows in cascade from one cell to the next.

DETAILED DESCRIPTION OF THE INVENTION

According to the invention, the regulation method for an electrolytic cell for the production of aluminium 1 by means of electrolytic reduction of alumina dissolved in an electrolyte bath 13 based on cryolite, said cell 1 comprising a pot 20, anodes 7 and cathode components 5, 6 capable of circulating a so-called electrolytic current in said bath, the aluminium produced by means of said reduction forming a pad referred to as a "liquid metal pad" 12 on said cathode components 5, 6, said method comprising the supply of said cell with alumina in said bath and being characterised in that it comprises:

the set-up of a regulation sequence comprising a series of time intervals p of a duration Lp hereafter referred to as "regulation periods" or simply "periods";

the determination of a mean temperature T(p) of the electrolyte bath, from at least one measurement of the temperature of said bath made during the last period or at least one of the last Nt periods;

the determination of a so-called "equivalent" quantity Qc1(p) of $AlF_3$ contained in the alumina added to the cell during the period p;

the determination of a value Qm(p) of the total equivalent $AlF_3$ supplies per period during the last period or during the last N periods;

the determination of a quantity Q(p) of aluminium trifluoride ($AlF_3$) to be added during the period p, referred to as "determined quantity Q(p)", using the formula:

$$Q(p)=Qint(p)-Qc1(p)+Qt(p),$$

where $Qint(p)=\alpha\times Qm(p)+(1-\alpha)\times Qint(p-1)$, $\alpha$ is a smoothing coefficient setting the temporal smoothing horizon of the integral term Qint(p), Qt(p) is a determined function, preferentially increasing, of the difference between said temperature T(p) and a set-point temperature To, the addition in said electrolyte bath, during the period p, of an effective quantity of aluminium fluoride ($AlF_3$) equal to said determined quantity Q(p).

The term Q(p) corresponds to an addition of pure $AlF_3$ and is typically expressed in kg of pure $AlF_3$ per period (kg/period). The expression "addition of an effective quantity of $AlF_3$" corresponds to an addition of pure $AlF_3$. In industrial practice, $AlF_3$ additions are generally made using so-called industrial $AlF_3$ with a purity of less than 100% (typically 90%). In this case, a sufficient quantity of industrial $AlF_3$ is added to obtain the effective quantity of $AlF_3$ required. Typically, a quantity of industrial $AlF_3$ equal to the effective quantity of $AlF_3$ required divided by the purity of the industrial $AlF_3$ used is added.

The expression "total $AlF_3$ additions" refers to the sum of the effective additions of pure $AlF_3$ and the "equivalent" $AlF_3$ additions from alumina.

$AlF_3$ may be added in different ways. It may be added manually or mechanically (preferentially using a point feed such as an crustbreaker-feeder which makes it possible to add determined doses of $AlF_3$, in an automated fashion if required). $AlF_3$ may be added with alumina or at the same time as alumina.

The different terms of Q are determined preferentially at each period p. If the cell is very stable, it may be sufficient to determine the quantity Q(p) and some of the terms forming it, in a more staggered manner over time, for example once every two or three periods.

The quantity Q(p) is normally determined at each period. If one or more terms of Q(p) cannot be calculated during a given period, then it is possible to maintain the value of said term(s) used during the previous period, i.e. the value of said term(s) will be determined by making it equal to the value used during the last period. If one or more terms cannot be calculated during several periods, then it is possible to retain the value of said term(s) used during the previous period for which it could be calculated and maintain this value for a limited number Ns of periods (Ns being typically equal to 2 or 3). In the latter case, if said term(s) still cannot be calculated after the Ns periods, then it is possible to retain the pre-determined fixed value, referred to as the "standby value". These different situations may occur, for example, when the mean temperature of the pot cannot be determined or when the equivalent $AlF_3$ quantity contained in the alumina could not be determined.

The intervals (or "periods") p are preferentially approximately equal in length Lp, i.e. the length Lp of the periods is approximately the same for all the periods, enabling easier implementation of the invention. Said length Lp is generally between 1 and 100 hours.

Figure 2:
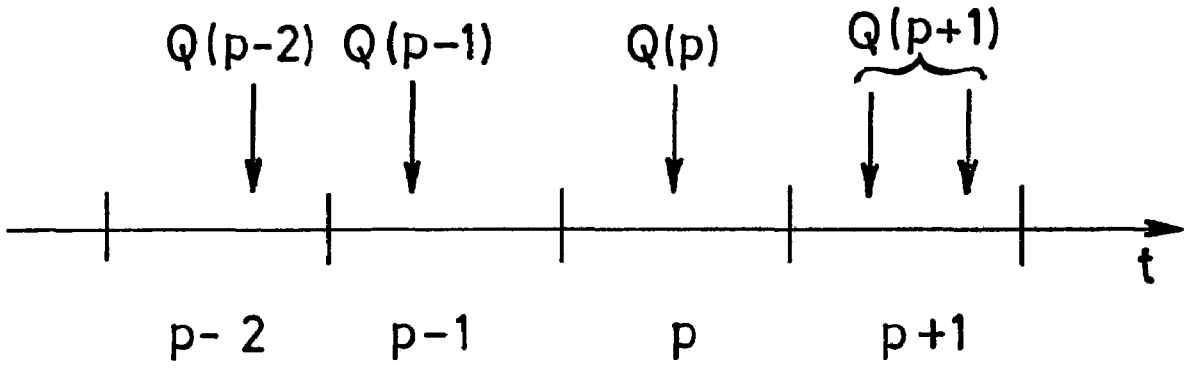
FIG. 2 illustrates the principle of the regulation sequences according to the invention.
Figure 3:
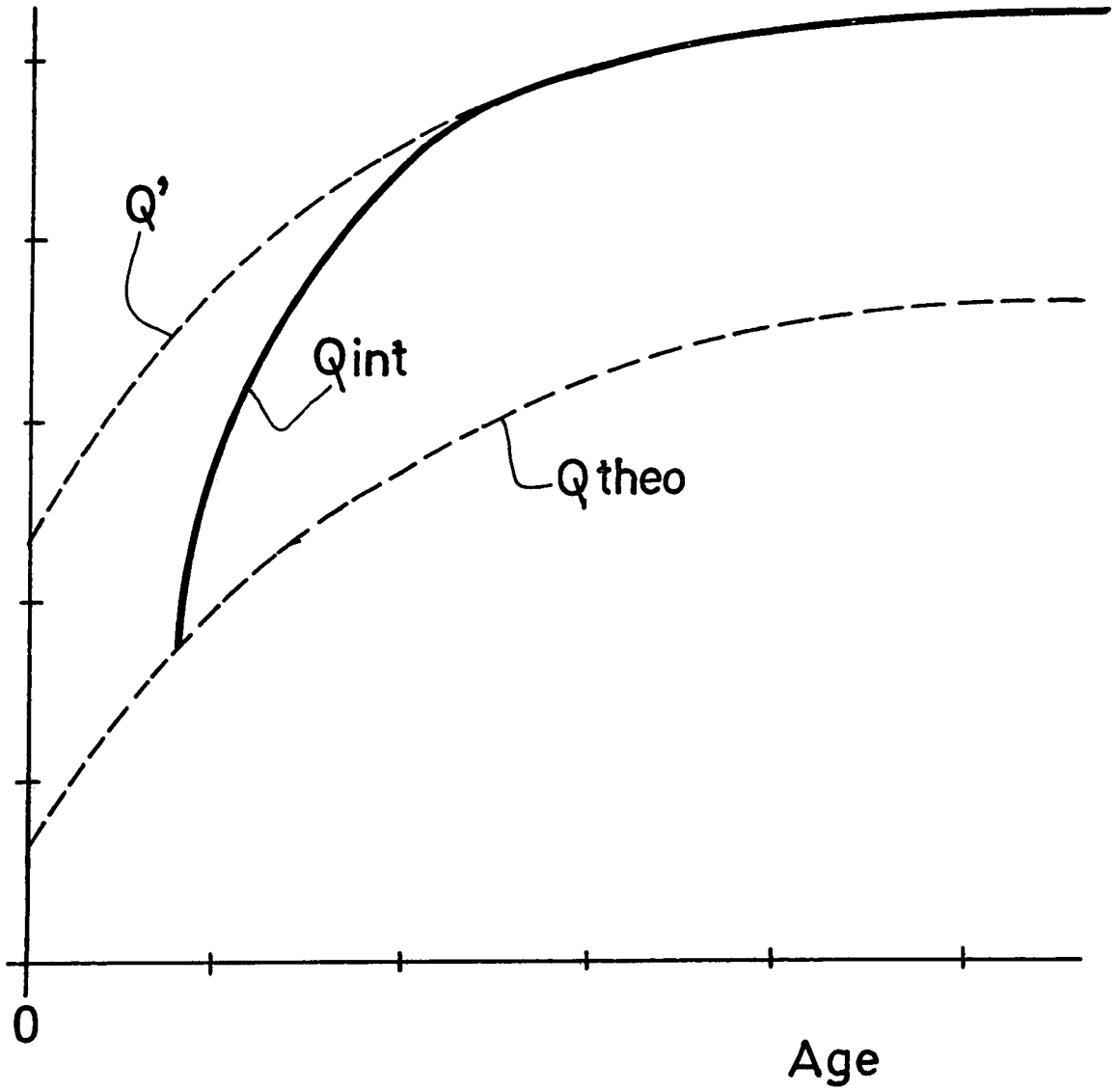
FIG. 3 shows variations in the total $AlF_3$ requirements of an electrolytic cell.

As shown in FIG. 2, the additions of $AlF_3$ may be made at any time during said regulation periods (or sequences), which may correspond to the work shifts which determine the frequency of the changes of the shifts in charge of cell control and maintenance. The quantity Q(p) of $AlF_3$ determined for a period p may be added in one or more times during said working period. Preferentially, the quantity Q(p) is added practically continuously using crustbreaker-feeders which make it possible to add predetermined doses of $AlF_3$ throughout the period p.

In a preferred alternative embodiment of the invention, the term Qm(p) is calculated using the equation:

$$Qm(p)=\langle Q(p)\rangle+\langle Qc1(p)\rangle, \text{ where}$$

$\langle Q(p)\rangle=Q(p-1)$ and $\langle Qc1(p)\rangle=Qc1(p-1)$ when the term Qm(p) is determined using the total equivalent $AlF_3$ supplies during the last period, i.e. p−1;

$\langle Q(P)\rangle=(Q(p-N)+Q(p-N+1)+\ .\ .\ .\ +Q(p-1))/N$, and $\langle Qc1(p)\rangle=(Qc1(p-N)+Qc1(p-N+1)+\ .\ .\ .\ +Qc1(p-1))/N$, when the term Qm(p) is determined using total equivalent $AlF_3$ supplies during the last N periods, i.e. p−1, p−2, . . . , N.

Therefore, in the latter case, the term Qm(p) is equal to $(Q(p-2)+Qc1(p-2)+Q(p-1)+Qc1(p-1))/2$ when N=2; $(Q(p-3)+Qc1(p-3)+(Q(p-2)+Qc1(p-2)+Q(p-1)+Qc1(p-1))/3$ when N=3, . . .

The value of the parameter N is selected according to the cell reaction time and is normally between 2 and 100, and more typically between 2 and 20.

In order to converge the integral term Qint(p) rapidly to the quantity Q' corresponding to actual cell requirements, it is possible to start the method by simply taking Qint(0)=Qtheo, where Qtheo corresponds to the total theoretical $AlF_3$ requirements of the cell when regulation is started. Qtheo is a function of the age of the pot which can be determined statistically for each type of pot.

This alternative embodiment may be implemented by including in the method according to the invention:

the determination of a quantity Qtheo corresponding to the total theoretical $AlF_3$ requirements of the cell when regulation is started;

the start-up of the method by taking Qint(0)=Qtheo.

The smoothing coefficient $\alpha$, which makes it possible to do away with medium and long-term thermal and chemical fluctuations, is equal to Lp/Pc, where Pc is a period which is typically of the order of 400 to 8000 hours, and more typically of 600 to 4500 hours, and Lp is the length of one period. Therefore, the term $1/\alpha$ is typically equal to 50 to 1000 8-hour periods if this work organisation mode is applied.

The term Qc1(p) is determined by producing the chemical balance of the fluorine and sodium contained in said alumina from one or more chemical analyses. The effect of the sodium contained in the alumina is to neutralise fluorine, then amounting to a negative quantity of $AlF_3$. The term Q1c(p) is positive if said alumina is "fluorinated" (which is the case when it has been used to filter electrolytic cell effluents) and negative if the alumina is "fresh", i.e. if it is produced directly from the Bayer process.

Figure 4:
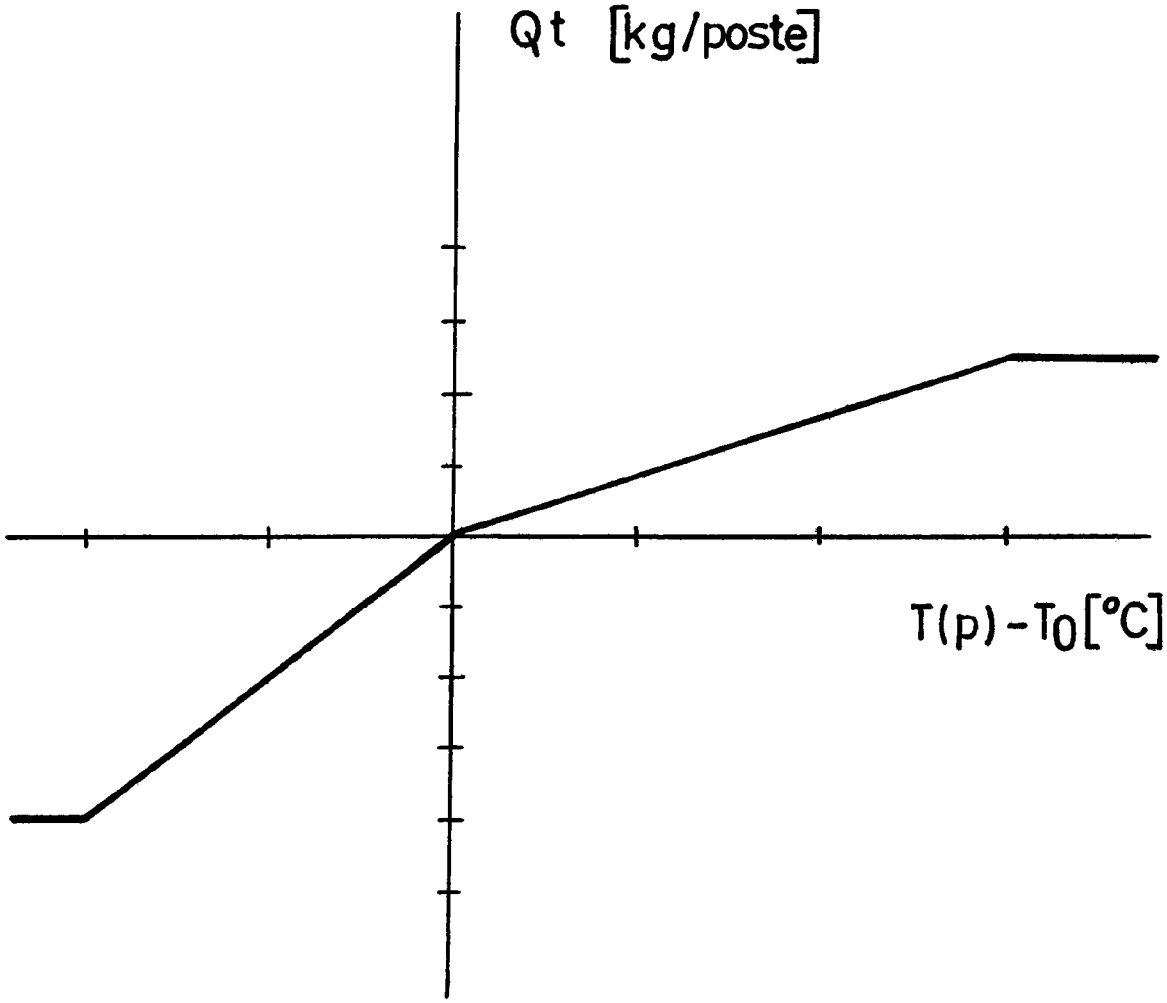
FIGS. 4 and 5 show typical functions used to determine the terms of Qt and Qc2.

The regulation term Qt(p) is given by a determined function (typically increasing and preferentially limited by a maximum value and a minimum value) of the difference between the measured temperature of the bath T(p) and a set-point temperature To. FIG. 4 shows a typical function used to determine the term Qt.

This alternative embodiment may be implemented by including in the method according to the invention:

the determination of a mean temperature T(p) of the electrolyte bath;

the determination of the term Qt(p) using a determined function (which is typically increasing and preferentially limited) of the difference between said temperature T(p) and the set-point temperature To.

In a simplified alternative embodiment of the invention, the term Qt(p) may follow a simple equation, such as Qt(p)=Kt×(T(p)−To), where Kt is a constant which is typically positive and which may be set empirically and wherein the value is typically between 0.01 and 1 kg/hour/° C., and more typically between 0.1 and 0.3 kg/hour/° C. (corresponding, in the latter case, to approximately 1 to 2 kg/period/° C. for 8-hour periods) for 300 kA to 500 kA pots.

The term Qt(p) is preferentially limited by a minimum value and by a maximum value.

The mean temperature T(p) is normally determined from temperature measurements made on the period p and on the previous periods p−1, etc., so as to obtain a reliable and significant value of the average condition of the pot.

Figure 5:
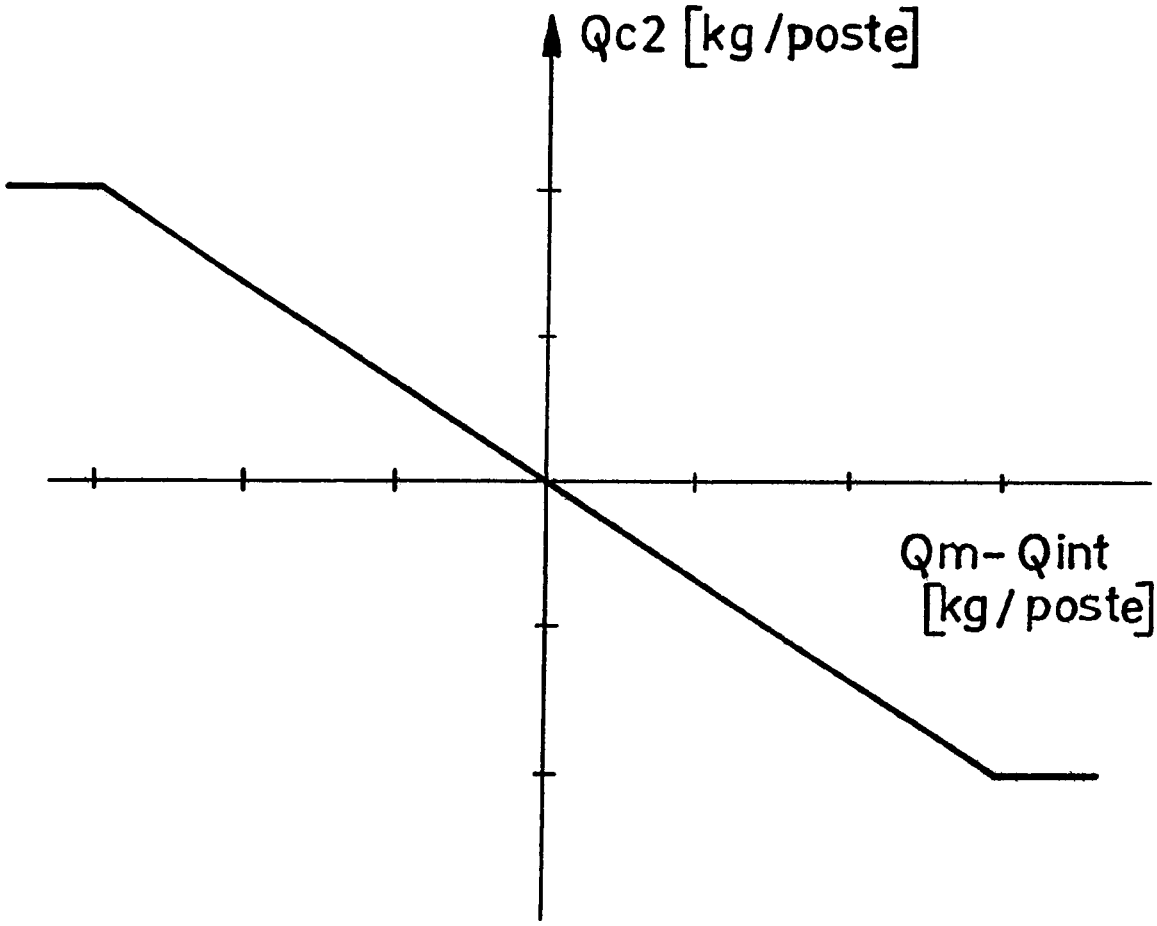

The term Qc2(p) is given by a determined function (which is typically decreasing and preferentially limited) of the difference Qm(p)−Qint(p). This damping term takes into account the delay in the reaction of the cell with the $AlF_3$ additions. FIG. 5 shows a typical function used to determine the term Qc2.

In a simplified alternative embodiment of the invention, the term Qc2(p) may follow a simple equation, such as Qc2(p)=Ko2×(Qm(p)−Qint(p)), where Ko2 is a constant which is typically negative and which may be set empirically and wherein the value is typically between −0.1 and −1, and more typically between −0.5 and −1 for 300 kA to 500 kA pots.

The term Qc2(p) is preferentially limited by a minimum value and by a maximum value.

In an advantageous alternative embodiment of the method according to the invention, the quantity Q(p) comprises an additional regulation term, Qr(p), which is sensitive to the thickness (and, to a lesser extent, the shape) of the solidified bath ridge 15 formed on the walls 3 of the cell 1 via the spreading $\eta$ of the lines of current in the electrolyte bath.

Figure 6:
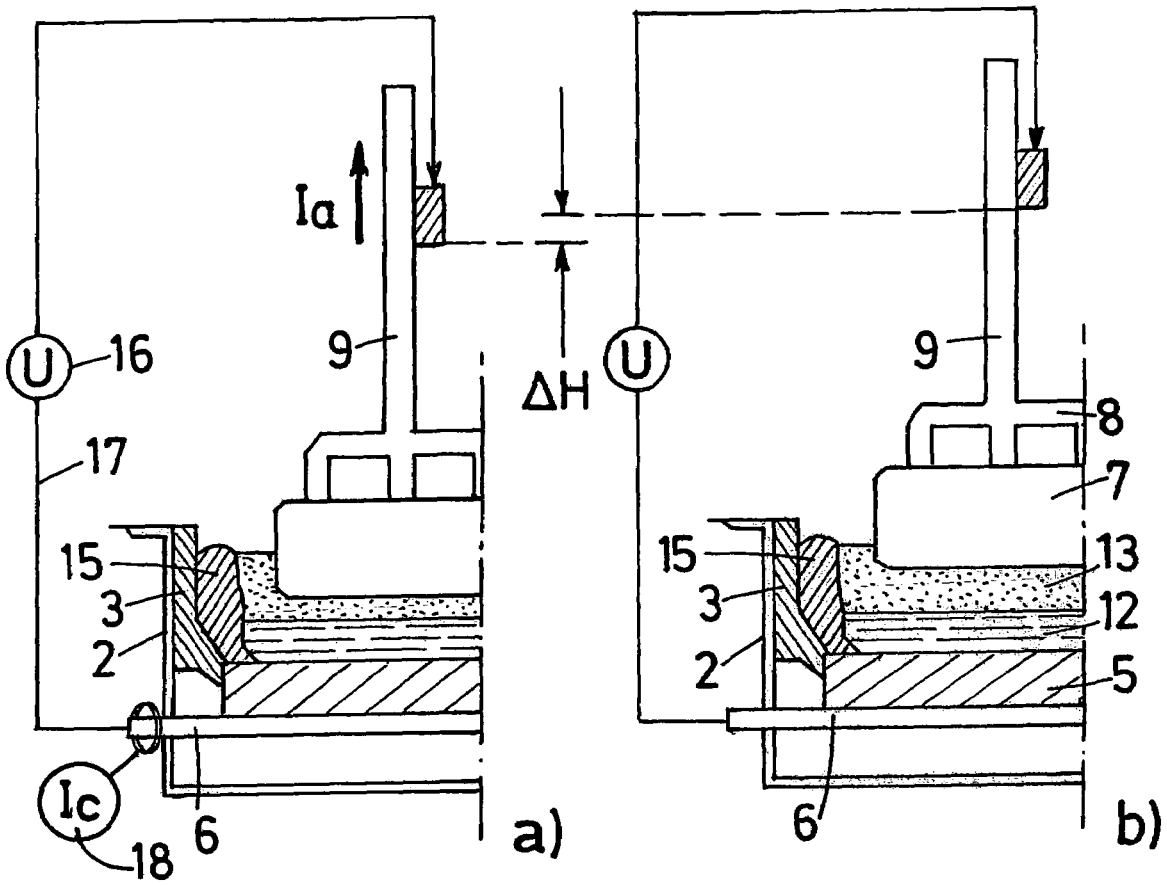
FIG. 6 illustrates a method to determine the specific electric resistance variation of the electrolytic cell.

This term may particularly be used when the electrolytic cell comprises a mobile anode frame 10 to which the anodes 7 of the cell are attached and means (not shown) to move said anode frame 10. As shown in FIG. 6, said resistance is typically measured using means 18 to measure the intensity Io of the current circulating in the cell (where Io is equal to the sum of the cathode currents Ic or anode current Ia) and means 16, 17 to measure the resulting drop in voltage U at the cell terminals (and more specifically the resulting drop in voltage between the anode frame and the cathode components of the cell). Said resistance is generally calculated using the equation: R=(U−Uo)/Io, where Uo is a constant typically between 1.6 and 2.0 V.

The term Qr(p) is given by a determined function (which is typically decreasing and preferentially limited) of a quantity referred to as "specific resistance variation" ΔRS which is equal to ΔR/ΔH, where ΔR is the variation of the resistance R at the terminals of the electrolytic cell when the anode frame 10 is moved by a determined distance ΔH, either upwards (AH positive), or downwards (ΔH negative). In practice, it was found to be simpler to give an order of movement of the anode frame 10 for a determined time and measure the resulting frame movement ΔH. The term Qr(p) is advantageously a function of the difference between ΔRS and a reference value ΔRSo.

According to this alternative embodiment of the invention, the method advantageously comprises:

the movement of the anode frame 10 by a determined distance ΔH, either upwards (ΔH being positive in this case), or downwards (ΔH being negative in this case);

the measurement of the variation ΔR of the resistance R resulting from said movement;

the calculation of a specific resistance variation ΔRS using the formula:

$$\Delta RS=\Delta R/\Delta H;$$

the determination of a term Qr(p) using a determined function (which is typically decreasing) of the specific resistance variation ΔRS;

the addition of the term Qr(p) in the determination of the quantity Q(p).

Figure 7:
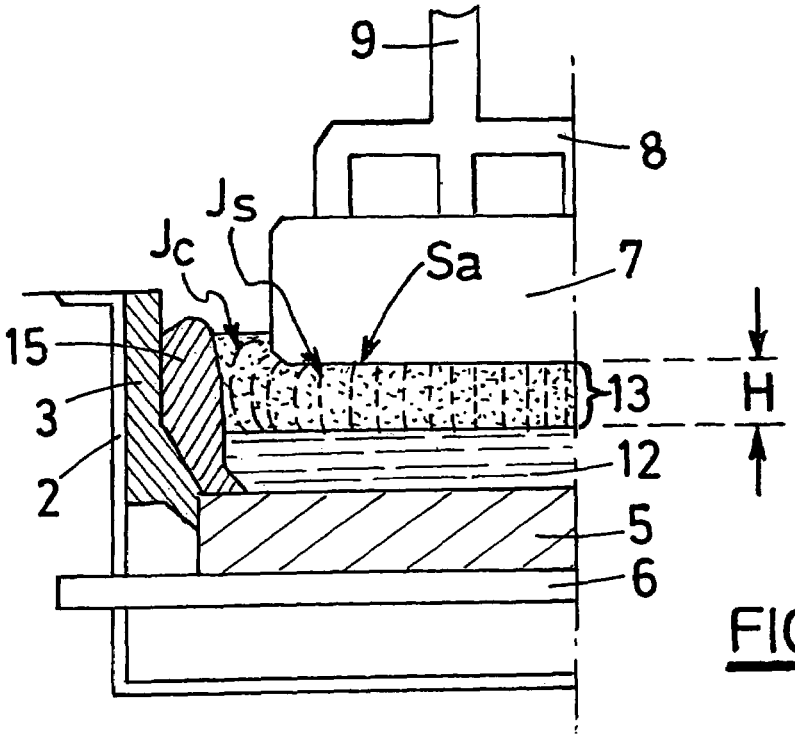
FIG. 7 is a schematic illustration of the shape of the current lines flowing in the electrolyte bath between an anode and the liquid metal pad.

The resistance R depends not only on the resistivity p of the electrolyte bath 13, on the distance H between the anode(s) 7 and the liquid metal pad 12, and on the surface area Sa of the anode(s) 7, but also on the spreading $\eta$ of the lines of current Jc, Js which are established in said bath, particularly between the anode(s) 7 and the solidified bath ridge 15 (lines Jc in FIG. 7). The applicant had the idea to make use of the fact that the specific electric resistance variation ΔRS is not only sensitive to the resistivity of the electrolyte bath, but integrates an electric current spreading factor, which is sensitive to the presence, size and, to a lesser degree, shape of the solidified bath ridge 15 on the walls of the pot 20.

The applicant also observed that, unlike that which is normally admitted, the spreading η is in fact a preponderant factor in the establishment of electric resistance. The applicant considers that the contribution of spreading to the specific electric resistance variation is typically between 75 and 90%, which means that the contribution of the resistivity is very low, that is typically between 10 and 25% (typically 15%). In its tests on 500 kA pots, the applicant observed a mean ΔRS value of the order of 100 mΩ/mm, which decreases by approximately −3 nΩ/mm when the bath temperature increases by 5° C. and when the $AlF_3$ content decreases by 1%, and conversely. The contribution of the resistivity to this variation is estimated to be only of the order of −0.5 nΩ/mm (that is only approximately 15% of the total value), the contribution attributable to spreading, i.e. −2.5 nΩ/mm being dominant.

It is possible to take into account the spreading of the current in the resistance measured (for example by modelling the current lines), which considerably improves the reliability of the corrective term Qr(p) as an indicator of the thermal state of the cell.

In a simplified alternative embodiment of the invention, the term Qr(p) may be given by a simple equation such as: Qr(p)=Kr×(ΔRS−ΔRSo), where Kr is a constant which may be set empirically and wherein the value is typically between −0.01 and −10 kg/hour/nΩ/mm, and more typically between −0.05 and −0.3 kg/hour/nΩ/mm (corresponding, in the latter case, to approximately −0.5 to −2 kg/period/nΩ/mm for 8-hour periods) for 300 kA to 500 kA pots.

The term Qr(p) is preferentially limited by a minimum value and by a maximum value.

In practice, it is possible to make Nr measurements of ΔRS (i.e. two or more measurements) during the period p. The ΔRS value used to calculate Qr(p) will in this case be the mean of the Nr measured ΔRS values, except, if applicable, values considered to be aberrant. It is also possible to use a sliding mean on two or more periods to smooth the thermal fluctuations related to the operating cycle. An operating cycle is determined by the frequency of interventions on the electrolytic cell, particularly anode replacements and liquid metal sampling. The length of an operating cycle is generally between 24 and 48 hours (for example 4×8-hour periods).

In another advantageous alternative embodiment of the method according to the invention, the quantity Q(p) comprises an additional regulation term, Qs(p), which is given by a determined function (which is typically increasing and preferentially limited) of the difference between the surface area S(p) of the liquid metal pad 12 and a set-point value So.

According to this alternative embodiment of the invention, the method advantageously comprises:

the determination of a term Qs(p);

the addition of the term Qs(p) in the determination of the quantity Q(p).

The surface area S(p), which corresponds approximately to the metal/bath interface, is approximately equal to the horizontal right section of the electrolytic pot. The presence of solidified electrolyte bath on the walls of the pot decreases this surface area by a quantity which varies as a function of time and pot operating conditions.

The term Qs(p) is given by a determined function (which is typically increasing and preferentially limited) of the difference S(p)−So. In a simplified alternative embodiment of the invention, the term Qs(p) may be given by a simple equation such as: Qs(p)=Ks×(S(p)−So), where Ks is a constant which may be set empirically and wherein the value is typically between 0.0001 and 0.1 kg/hour/$dm^2$, and more typically between 0.001 and 0.01 kg/hour/$dm^2$ (corresponding, in the latter case, to approximately 0.01 to 0.05 kg/period/$dm^2$ for 8-hour periods) for 300 kA to 500 kA pots.

The term Qs(p) is preferentially limited by a minimum value and by a maximum value.

Figure 8:
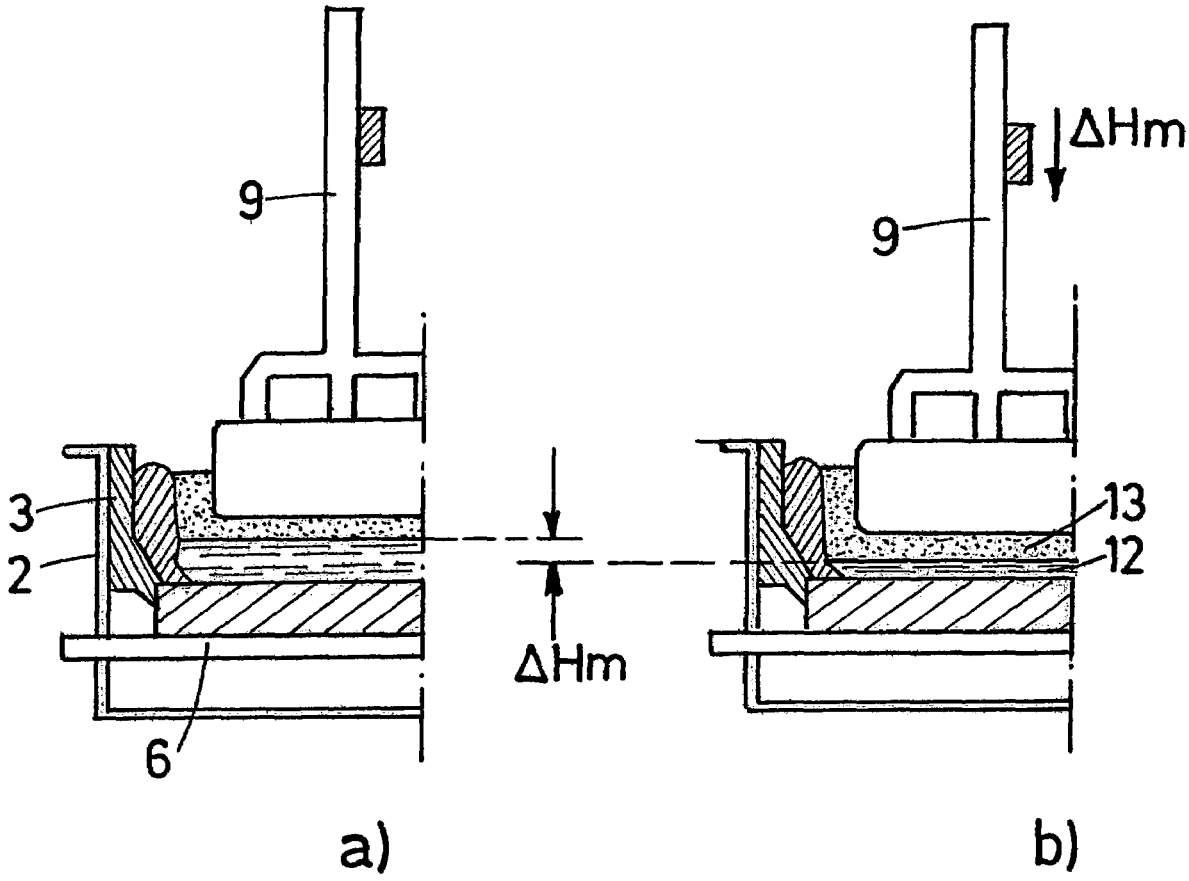
FIG. 8 illustrates a method to determine the surface area of the liquid metal pad.

In the preferred embodiment of this alternative embodiment of the invention, the surface area S(p) is calculated from a measurement of the volume Vm of metal tapped and the fall ΔHm of the corresponding metal level Hm (see FIG. 8). More specifically, the volume Vm of liquid metal extracted from the electrolytic pot is measured (typically with a measurement of this metal mass) and the change ΔHm of the resulting liquid metal level, and the surface area S(p) is then calculated using the equation S(p)=Vm/ΔHm. In practice, in order to maintain the metal/anode distance constant, the anodes 9 are normally lowered at the same time as the liquid metal level.

The applicant noted that the corrective terms Qr(p) and Qs(p) according to the present application are effective indicators of the overall thermal state of the electrolytic cell, which take into account both the liquid electrolyte bath and the solidified bath ridge on the walls of the pot. These terms, taken separately or in combination, particularly make it possible to reduce the number of analyses of the $AlF_3$ content in the liquid electrolyte bath markedly and thus complete the correction made by the term Qt(p). The applicant observed that the frequency of the analyses of the $AlF_3$ content may be reduced typically to one analysis per cell approximately every 30 days. The terms Qr(p) and Qs(p) make it possible to only perform $AlF_3$ content analyses in exceptional cases or in order to characterise a cell or a series of cells statistically.

In another advantageous alternative embodiment of the invention, the quantity Q(p) comprises an additional corrective term Qe(p) which is a determined function (which is typically decreasing and preferentially limited) of the difference between the excess $AlF_3$ measured E(p) and its target value Eo, i.e. the difference E(p)−Eo.

This alternative embodiment may be implemented by including in the method according to the invention:

the measurements of the excess $AlF_3$ E(p);

the determination of an additional corrective term Qe(p) using a determined function (typically decreasing and preferentially limited) of the difference between the excess $AlF_3$ measured E(p) and its target value Eo, i.e. the difference E(p)−Eo;

the determination of the quantity Q(p) by adding the term Qe(p) in the calculation.

In a simplified alternative embodiment of the invention, the term Qe(p) may be given by a simple equation such as: Qe(p)=Ke×(E(p)−Eo), where Ke is a constant which may be set empirically and wherein the value is typically between −0.05 and −5 kg/hour/% $AlF_3$, and more typically between −0.5 and −3 kg/hour/% $AlF_3$ (corresponding, in the latter case, to approximately −20 to −5 kg/period/% $AlF_3$ for 8-hour periods) for 300 kA to 500 kA pots.

The term Qe(p) is preferentially limited by a minimum value and by a maximum value.

The applicant found it was satisfactory to only apply the term Qe(p) exceptionally, for a short length of time, when the thermal operation of the cell leaves the normal operating range, i.e. when the indicators (such as the temperature, ΔRS, S, etc.) leave the so-called safety ranges.

The applicant noted in its tests that the corrective term Qe enabled the indicators (temperature, ΔRS, S, etc.) to return rapidly to the normal operating range.

According to another alternative embodiment of the invention, it is also possible to add corrective terms to take into account individual interfering events.

In particular, the regulation may comprise a so-called anode effect term Qea to take into account the impact of an anode effect on the thermics of an electrolytic cell. An anode effect particularly induces significant $AlF_3$ losses by emission and, generally, heating of the electrolyte bath. The term Qea is applied for a limited time following the observation of an anode effect. The term Qea is calculated using either a scale which is a function of the anode effect energy (AEE), or a fixed mean value. In the first case, the term Qea is given by a determined function (which is typically increasing and preferentially limited) of the energy AEE. The term Qea(p) is preferentially limited by a minimum value and by a maximum value.

Industrial bath and pure cryolite additions are sometimes performed on industrial cells. These additions have an impact on the composition of the electrolyte bath which must generally be taken into account in the regulation. For this purpose, the regulation method may also comprise a corrective term Qb to take into account the modification of the pure $AlF_3$ content induced by these additions.

In order to prevent excess $AlF_3$ additions, it is preferable, as a precaution, to limit Q(p) to a maximum value Qmax. It is also preferable to limit the application of the regulation terms in time when they cannot be determined at each period.

The applicant observed that it was sufficient to only apply some of the terms of Q(p), such as Qe(p), exceptionally and for a limited length of time, which makes it possible to limit costs relating to their determination.

The term Q(p) may be positive, null or negative. In the last case, it is assumed that Q(p)=0, i.e. $AlF_3$ is not added during the period p. When the term Q(p) is negative, it is also possible to correct the composition of the electrolyte bath 13 by adding soda, i.e. calcined soda or sodium carbonate, referred to as soda ash.

EXAMPLES OF EMBODIMENTS OF THE INVENTION

The following examples illustrate the calculations inherent to the regulation method according to the invention. These calculations are typical of those made for the 500 kA cells tested by the applicant. The length of the periods is 8 hours.

Example 1

Example illustrating the use of the basic terms Qint, Qc1, Qc2 and Qt for a pot of average age (28 months).

The value of Qtheo at 28 months is +31 kg/period. The average requirements of the cell Q' determined by the integral term Qint are +39 kg/period.

The alumina analysis gives a value of 1.36% of fluorine and 5250 ppm of $Na_2O$ equivalent. The alumina consumption of the cell during one 8-hour period is 2400 kg. The term Qc1 is then equal to +22 kg/period in equivalent pure $AlF_3$ supply.

By taking N=12, the total actual $AlF_3$ supplies per period over the last N periods is 44 kg/period. The difference between the actual supplies (44 kg/period) and the mean requirements (39 kg/period) is then +5 kg/period. The term Qc2 is then equal to −3 kg/period.

The temperature measured is 957° C. and the set-point temperature 953° C., i.e. a difference of +4° C. The corrective term Qt is then equal to +7 kg/period.

The quantity of $AlF_3$ to be added during the period p is then equal to: Q(p)=Qint(p)−Qc1(p)+Qc2(p)+Qt(p)=39−22−3+7=+21 kg.

Example 2

Example illustrating the use of the basic terms Qint, Qc1, Qc2 and Qt for a young pot (7 months).

The value of Qtheo at 7 months is +23 kg/period. The average requirements of the cell Q' determined by the integral term Qint are +32 kg/period. The term Qc1 is equal to +20 kg/period in equivalent pure $AlF_3$ supply. The term Qc2 is equal to −6 kg/period.

The temperature measured is 964.6° C. and the set-point temperature 956° C., i.e. a difference of +8.6° C. The corrective term Qt is then equal to +15 kg/period.

The quantity of $AlF_3$ to be added during the period p is then equal to: Q(p)=Qint(p)−Qc1(p)+Qc2(p)+Qt(p)=32−20−6+15=+21 kg.

Example 3

Example illustrating the use of the basic terms Qint, Qc1, Qc2 and Qt, corrected with term Qe for a young cell (6 months).

The value of Qtheo at 7 months is +23 kg/period. The average requirements of the cell Q' determined by the integral term Qint are +32 kg/period. The term Qc1 is equal to +20 kg/period in equivalent pure $AlF_3$ supply. The term Qc2 is equal to −6 kg/period. The corrective term Qt is equal to +15 kg/period.

The $AlF_3$ rate measured is 12.8% and the set-point value is 12.0%. The value of Qe is then −14 kg/period.

The quantity of $AlF_3$ to be added during the period p is then equal to: Q(p)=Qint(p)−Qc1(p)+Qc2(p)+Qt(p)+Qe(p)=32−20−6+15−14=+7 kg. The term Qe thus prevents an over-correction of the $AlF_3$ content.

Example 4

Example illustrating the use of the additional terms Qr and Qs in combination with the basic terms Qint, Qc1, Qc2 and Qt.

The value of Qtheo at 28 months is +31 kg/period. The average requirements of the cell Q' determined by the integral term Qint are +39 kg/period. The term Qc1 is equal to +22 kg/period in equivalent pure $AlF_3$ supply. The term Qc2 is equal to −3 kg/period.

The temperature measured is 964° C. and the set-point temperature 953° C., i.e. a difference of +10.8° C. The corrective term Qt is then equal to +18 kg/period.

The ΔRS value measured is 101.8 nΩ/mm and the set-point value ΔRSo is 106.0 nΩ/mm. The term Qr(p) is then equal to +5 kg/period.

The S value measured is 6985 $dm^2$ and the set-point value So is 6700 $dm^2$. The term Qs(p) is then equal to +5 kg/period.

The quantity of $AlF_3$ to be added during the period p is then equal to: Q(p)=Qint(p)−Qc1(p)+Qc2(p)+Qt(p)+Qr(p)+Qs(p)=39−22−3+18+5+5=+42 kg. The terms Qr and Qs make a significant correction to the quantity Q(p).

Tests

The method according to the invention was used to regulate electrolytic cells with intensities of up to 500 kA. The length of the periods was 8 hours.

The tests related to different types of pots. Table I contains the characteristics of some of the electrolytic cells placed under test and the typical results obtained. In case A, the pots were regulated using the embodiment of the invention wherein Q(p) was determined using the terms Qint(p), Qc1(p), Qc2(p) and Qt(p). In case B, the pots were regulated using the embodiment of the invention wherein Q(p) was determined using the terms Qint(p), Qc1(p), Qc2(p), Qt(p) and Qe(p). In case C, the pots were regulated using the embodiment of the invention wherein Q(p) was determined using the terms Qint(p), Qc1(p), Qc2(p), Qt(p), Qr(p) and Qs(p).

The results show that the regulation method according to the invention makes it possible to regulate electrolytic cells effectively wherein the excess $AlF_3$ of the bath is grater than 11% and wherein the bath temperature is in the vicinity of 960° C. The preferred alternative embodiments of the invention make it possible to regulate effectively, and with a surprising stability, electrolytic cells wherein the intensity and anode density are very high and wherein the liquid bath mass is low.

TABLE 1

| | Case A | Case B | Case C |
|---|---|---|---|
| Intensity (kA) | 300 kA | 330 kA | 500 kA |
| Anode density (A/cm$^2$) | 0.78 | 0.85 | 0.90 |
| Liquid bath mass (kg/kA) | 25 | 22 | 17 |
| Excess $AlF_3$ (%) | 11.8 | 11.8 | 13.2 |
| Total standard deviation (σ %) | 1.5 | 1.3 | 1.3 |
| Dispersion of excess $AlF_3$ at ±2 σ % | 8.8–14.8 | 9.2–14.4 | 10.6–15.8 |
| Bath temperature (° C.) | 962 | 962 | 961 |
| Total standard deviation (σ %) | 6 | 6 | 3.5 |
| Dispersion of temperature at ±2 σ % | 950–974 | 950–974 | 954–968 |
| Current efficiency (%) | 95.0 | 95.0 | 95.5 |

The applicant observed during its tests that the regulation method according to the invention makes it possible to control, with high stability, the $AlF_3$ content of electrolytic cells, over a period of several months, without having to take into account measured $AlF_3$ contents, said measured contents are, in any case, easily affected by significant errors.

Advantages of the Invention

The method according to the invention makes it possible to account not only for the average composition of the electrolyte bath of an electrolytic cell, but also the impact of the solidified bath ridges on this composition, said ridges, by eroding or growing, affect the bath composition.

The invention claimed is:

1. Regulation method for an electrolytic cell for the production of aluminium by means of electrolytic reduction of alumina dissolved in an electrolyte bath based on cryolite, said cell comprising a pot, anodes and cathode components capable of circulating a so-called electrolytic current in said bath, the aluminium produced by means of said reduction forming a pad referred to as a "liquid metal pad" on said cathode components, said method comprising the supply of said cell with alumina in said bath and wherein it comprises:

the set-up of a regulation sequence comprising a series of time intervals p of a duration Lp referred to as "periods";

the determination of a mean temperature T(p) of the electrolyte bath, from at least one measurement of the temperature of said bath made during the last period or at least one of the last Nt periods;

the determination of a so-called "equivalent" quantity Qc1 (p) of $AlF_3$ contained in the alumina added to the cell during the period p;

the determination of a value Qm(p) of the total equivalent $AlF_3$ supplies per period during the last period or during the last N periods;

the determination of a quantity Q(p) of aluminium trifluoride ($AlF_3$) to be added during the period p, referred to as "determined quantity Q(p)", using the formula:

$$Q(p)=Qint(p)-Qc1(p)+Qt(p), \text{ where}$$

$$Qint(p)=\alpha\times Qm(p)+(1-\alpha)\times Qint(p-1),$$

α is a smoothing coefficient,

Qt(p) is a determined function of the difference between said temperature T(p) and a set-point temperature To, the addition in said electrolyte bath, during the period p, of an effective quantity of aluminium fluoride ($AlF_3$) equal to said determined quantity Q(p).

2. Regulation method according to claim 1, wherein the calculation formula of the quantity Q(p) comprises an additional term Qc2(p), i.e. Q(p)=Qint(p)−Qc1(p)+Qt(p)+Qc2(p), where Qc2(p) is a corrective term which is a determined function of the difference between Qm(p) and Qint(p).

3. Regulation method according to claim 1, wherein said length Lp of said periods is approximately the same for all the periods.

4. Regulation method according to claim 1, wherein said length Lp of said periods is between 1 and 100 hours.

5. Regulation method according to claim 1, wherein the term Qm(p) is calculated using the equation Qm(p)=<Q(p)>+<Qc1(p)>, where:

<Q(p)>=Q(p−1) and <Qc1(p)>=Qc1(p−1) when the term Qm(p) is determined using the total equivalent $AlF_3$ supplies during the last period;

<Q(p)>=(Q(p−N)+Q(p−N+1)+ . . . +Q(p−1))/N, and <Qc1(p)>=(Qc1(p−N)+Qc1(p−N+1)+ . . . +Qc1(p−1))/N, when the term Qm(p) is determined using total equivalent $AlF_3$ supplies during the last N periods.

6. Regulation method according to claim 5, wherein N is between 2 and 100.

7. Regulation method according to claim 1, wherein the coefficient α is equal to Lp/Pc, where Pc is between 400 and 8000 hours.

8. Method according to claim 1, wherein it comprises:

the determination of a quantity Qtheo corresponding to the total theoretical $AlF_3$ requirements of the cell when regulation is started;

the start-up of the method by taking Qint(0)=Qtheo.

9. Regulation method according to claim 1, wherein the term Qt(p) is given by the equation Qt(p)=Kt×(Tp−To), where Kt is a constant.

10. Regulation method according to claim 9, wherein Kt is between 0.01 and 1 kg/hour/° C.

11. Regulation method according to claim 1, wherein the term Qt(p) is limited by a minimum value and by a maximum value.

12. Regulation method according to claim 1, wherein the term Qc2(p) is given by the equation Qc2(p)=Ko2×(Qm(p)−Qint(p)), where Ko2 is a constant.

13. Regulation method according to claim 12, wherein Ko2 is between −0.1 and −1.

14. Regulation method according to claim 1, wherein the term Qc2(p) is optionally limited by a minimum value and by a maximum value.

15. Regulation method according to claim 1, wherein, when the electrolytic cell comprises a mobile anode frame to which said anodes are attached, the quantity Q(p) comprises an additional term Qr(p) which is a determined function of a quantity referred to as "specific resistance variation" ΔRS which is equal to ΔR/ΔH, where ΔR is the variation of the resistance R of the cell measured when said frame is moved by a determined distance ΔH, either upwards, ΔH being positive, or downwards, ΔH being negative.

16. Regulation method according to claim 15, wherein the term Qr(p) is given by the equation Qr(p)=Kr×(ΔRS−ΔRSo), where Kr is a constant and ΔRSo is a reference value.

17. Regulation method according to claim 16, wherein Kr is between −0.01 and −10 kg/hour/nΩ/mm.

18. Regulation method according to claim 15, wherein the term Qr(p) is optionally limited by a minimum value and by a maximum value.

19. Regulation method according to claim 1, wherein the quantity Q(p) comprises an additional term Qs(p) which is given by a determined function of the difference between the surface area S(p) of said liquid metal pad (12) and a set-point value So.

20. Regulation method according to claim 19, wherein the term Qs(p) is given by the equation Qs(p)=Ks×(S(p)−So), where Ks is a constant.

21. Regulation method according to claim 20, wherein Ks is between 0.0001 and 0.1 kg/hour/$dm^2$.

22. Regulation method according to claim 19, wherein the term Qs(p) is preferentially optionally limited by a minimum value and by a maximum value.

23. Regulation method according to claim 1, wherein the quantity Q(p) comprises an additional term Qe(p) given by a determined function of the difference between the excess $AlF_3$ measured E(p) and its target value Eo.

24. Regulation method according to claim 23, wherein the term Qe(p) is given by the equation Qe(p)=Ke×(E(p)−Eo), where Ke is a constant.

25. Regulation method according to claim 24, wherein Ke is between −0.05 and −5 kg/hour/% $AlF_3$.

26. Regulation method according to claim 23, wherein the term Qe(p) is optionally limited by a minimum value and by a maximum value.

27. Regulation method according to claims 1, wherein the quantity Q(p) comprises an additional term Qea(p) which is given by a determined function of the anode effect energy AEE.

28. Regulation method according to claim 27, wherein the term Qea(p) is optionally limited by a minimum value and by a maximum value.

29. Regulation method according to claim 1, wherein the quantity Q(p) is limited to a maximum value Qmax.

30. Regulation method according to claim 1, wherein, when the determined value of the term Q(p) is negative, its value is taken to be equal to zero, i.e. $AlF_3$ is not added during the period p.

* * * * *